US005322631A

United States Patent [19]

Fuchigami et al.

[11] Patent Number: 5,322,631

[45] Date of Patent: Jun. 21, 1994

[54] WATER-SOLUBLE LUBRICANT COMPOSITION

[75] Inventors: Masaharu Fuchigami; Tsuyoshi Ikeda; Masahiro Noda, all of Kanagawa, Japan

[73] Assignee: Yushiro Chemical Industry Co., Ltd., Tokyo, Japan

[21] Appl. No.: 143,386

[22] Filed: Oct. 29, 1993

Related U.S. Application Data

[63] Continuation of Ser. No. 876,329, Apr. 30, 1992, abandoned.

[30] Foreign Application Priority Data

May 2, 1991 [JP] Japan ..... 3-130418

[51] Int. Cl.[5] ..... C10M 135/10; C10M 129/58

[52] U.S. Cl. ..... 252/33.2; 252/35; 252/39

[58] Field of Search ..... 252/33.2, 35, 39

[56] References Cited

U.S. PATENT DOCUMENTS

| | | | |
|---|---|---|---|
| 2,415,353 | 2/1947 | Johnston et al. | 252/33.2 |
| 2,540,533 | 2/1951 | Kolfenbach et al. | 252/33.2 |
| 2,540,534 | 2/1951 | Kolfenbach et al. | 252/33.2 |
| 2,959,545 | 11/1960 | Alford | 252/33.2 |
| 3,170,879 | 2/1965 | Butcosk | 252/33.2 |
| 3,197,406 | 7/1965 | Konecky et al. | 252/33.2 |
| 3,290,130 | 12/1966 | Assmann | 252/33.2 |
| 3,684,726 | 8/1972 | Haak | 252/33.2 |
| 4,770,798 | 9/1988 | Bailleux et al. | 252/33.2 |
| 5,023,016 | 6/1991 | Gallacher et al. | 252/33.2 |
| 5,104,558 | 4/1992 | Matsuzaki | 252/33.2 |

*Primary Examiner*—Ellen M. McAvoy
*Attorney, Agent, or Firm*—Finnegan, Henderson, Farabow, Garrett & Dunner

[57] ABSTRACT

This invention relates to a water-soluble lubricant composition for a sleeve surface lubricating oil, an operating fluid, a cutting oil, a rolling oil, a drawing oil, a press oil or the like, which does not pollute the environment and has superior lubricity, metal corrosion preventing property, antifoaming property and antiseptic property. The water-soluble lubricant composition of this invention containing surfactants (a) and one or two salts (b) selected from among carboxylates and sulfonates is characterized in that the above one or two salts (b) selected from among carboxylates and sulfonates are alkaline earth metal salts or zinc salts and that substantially no nitrogen ingredients are contained and the amount of nitrogen contained represents its amount in impurities, or 0.5 wt % or below of nitrogen.

8 Claims, No Drawings

WATER-SOLUBLE LUBRICANT COMPOSITION

This application is a continuation, of application Ser. No. 07/876,329 filed Apr. 30, 1992, now abandoned.

BACKGROUND OF THE INVENTION

1. Field of the Invention

This invention relates to a water-soluble lubricant composition for a sleeve surface lubricating oil, an operating oil, a cutting oil, a rolling oil, a drawing oil, a press oil or the like. More particularly, this invention relates to a water-soluble lubricant composition which does not pollute the environment and has superior lubricity, metal corrosion preventing property, antifoaming property and antiseptic property.

2. Description of the Prior Art

A water-soluble lubricant composition for metal processing generally contains a mineral oil, a fat or oil, a carboxylic acid, an extreme pressure agent, a surfactant, an antifoaming agent, a metal corrosion preventing agent, an anti-oxidant, an antiseptic agent and the like and is diluted with water before use. The lubricant composition usually contains a nitrogen compound for giving it lubricity and the property of preventing metal corrosion in an aqueous system. Those nitrogen compounds include primary to tertiary alkanolamines, alkylamines, alkylarylamines, aralkylamines, cyclohexylamine, alkoxyalkylamines, diamines, addition products of alkylamine alkylene oxides, carboxylic acid amides and carboxylic acid alkylolamides (Japanese Patent Laid-open Nos. 7894/1980, 40400/1986, 235499/1986, 98696/1989, 201400/1989, 215889/1989, 242694/1989, etc.).

However, use of such water-soluble lubricant compositions for metal processing containing nitrogen compounds exerts a bad influence upon the earthly environment and contributes to environmental pollution.

Specifically, (1) although lubricants consisting of these compositions, after being used for metal processing, are subjected to waste water treatment and then discarded, these waste fluids still contain large amounts of nitrogen compounds. Therefore, discarding these waste fluids in waste water systems or sea areas results in eutrophication of rivers, lakes and seas thereby causing water pollution, red water and the like. Besides, (2) although it is theoretically possible to incinerate these waste fluids, in such a case, nitrogen compounds contained in the compositions are converted into the form of NOx and, when a sulfur compound is contained as an extreme pressure agent in the composition, the sulfur compound is converted into the form of SOx. These resulting compounds cause acid rain.

In addition, the conventional lubricant containing a nitrogen compound is unfavorable because it relatively easily foams, putrefies and corrodes non-ferrous metals. Especially when the lubricant is diluted with water and then supplied at high pressure to metallic parts to be processed, the lubricant significantly foams and causes problems such as its reduced performance and contamination of working environments.

SUMMARY OF THE INVENTION

Object of the Invention

The object of this invention, which is intended to solve these problems, is to provide a water-soluble lubricant composition which does not exert a bad influence upon earthly environment when it is discarded and has various superior properties such as lubricity, metal corrosion preventing property, antifoaming property and antiseptic property.

Characteristics of the Invention

The inventors, after intensive researches into the relations between the ingredients of a lubricant composition containing a maximumly possibly small amount of nitrogen compounds and its properties such as lubricity, metal corrosion prevention property and antiseptic property to solve the above problems of prior technology, have found that superior properties of a lubricant composition can be achieved by using specific amounts of compounds containing no nitrogen atoms in the composition and maximumly possibly restricting the amount of nitrogen contained in the whole composition. Thus this invention was completed.

That is to say, the water-soluble lubricant composition of this invention is one containing surfactants (a) and one or two salts (b) selected from among carboxylates and sulfonates, in which the above one or two salts (b) selected from among carboxylates and sulfonates are alkaline earth metal salts or zinc salts, substantially no nitrogen ingredients are contained and the amount of nitrogen contained represents its amount in impurities.

Effects of the Invention

As mentioned above, the water-soluble lubricant composition of this invention containing a maximumly possible small amount of nitrogen compounds. Therefore this water-soluble lubricant composition is free from eutrophication of rivers and seas accompanying waste water disposal and discharge of poisonous gases accompanying incineration treatment and does not cause any problem such as water pollution or air pollution. Furthermore, the lubricant composition of this invention is consisted of specific components, therefore exhibits superior lubricity, rust inhibiting property, antiseptic property, metal corrosion prevention property and antifoaming property.

DETAILED DESCRIPTION OF THE INVENTION

The above surfactants (a) used in this invention are one or at least two surfactants selected from the group consisting of etheric nonionic surfactants, esteric nonionic surfactants, sulfated oils, alkali metal salts of carboxylic acids and alkali metal salts of sulfonic acid.

Those compounds which can be used as the above "etheric nonionic surfactants" include polyoxyethylene alkyl ethers, polyoxyethylene alkylphenyl ethers, polyoxyethylene alkylnaphthyl ethers, polyoxyethylene abiethyl ethers and polyoxyethylene polyoxypropylene glycols. Those compounds which can be used as "esteric nonionic surfactants" include polyoxyethylene monocarboxylic acid esters, polyoxyethylene dicarboxylic acid esters, polyoxyethylene propylene glycol carboxylic acid esters, polyoxyethylene sorbitan monocarboxylic acid esters, polyoxyethylene sorbitan tricarboxylic acid esters, ethylene glycol monocarboxylic acid esters, propylene glycol monocarboxylic acid esters, diethylene glycol monocarboxylic acid esters, glycerin monocarboxylic acid esters, pentaerythritol monocarboxylic acid esters, sorbitan monocarboxylic acid esters, sorbitan sesquicarboxylic acid esters, sorbitan tricarboxylic acid esters and sucrose carboxylic acid esters.

Those compounds which can be used as "sulfated oils" include sulfation products of animal and plant fats and oils such as olive oil, castor oil, rape oil, beef tallow, hog fat, cotton seed oil and corn oil and those compounds which can be used as "alkali metal salts of carboxylic acids" include potassium salts of higher fatty acids, sodium petroleum sulfonate and sodium dinonyl naphthalenesulfonate.

As shown in claim 4, the above "carboxylates" may consist of one or at least two salts selected from among higher fatty acid salts and naphthenates. Higher fatty acids usually represent carboxylic acids containing at least 12 carbon atoms (e.g., lauric acid, myristic acid, palmitic acid, stearic acid, behenic acid, lanolin fatty acids and fatty acids which are polycondensation products of the above fatty acids).

Those compounds which can be used as the above sulfonates include alkane sulfonates, petroleum sulfonates, α-olefin sulfonates, α-sulfocarboxylates, alkyl sulfoacetates, dialkyl sulfosuccinates, monoalkyl sulfosuccinates, polyoxyethylene isooctylphenyl ether sulfonates, lower dialkyl naphthalenesulfonates, dinaphthylmethane sulfonates, alkylphenol sulfonates, lignin sulfonates, alkylbenzenesulfonates and alkylphenyl ether disulfonates.

These carboxylates and sulfonates are alkaline earth metal salts, zinc salts or lead (divalent) salts. It is more desirable to use a mixture (ultrabasic salt) of prescribed salts and an excess base. This is because these metal salts can achieve sufficient corrosion preventing property, antifoaming property and the like of the resulting composition but alkali metal salts, aluminum salts and ferric salts do not result in good properties of the resulting composition (especially rust inhibiting property becomes inferior in the latter two cases). Of these salts, alkaline earth metal salts are the most preferable. This is because they result in sufficient levels of the above properties of the resulting composition and because, when an alkaline earth salt especially a prescribed ultrabasic salt is used in a lubricant, air pollution can be prevented because an alkaline earth metal catches SOx generated during incineration and discard of a waste fluid even when the lubricant contains a sulfur compound as an extreme pressure agent. Therefore, it is preferable to use alkaline earth metal salts of higher fatty acids or alkaline earth metal salts of naphthenic acids as carboxylates and, as shown in claim 5, to use alkaline earth metal salts of petroleum sulfonic acid as sulfonates.

As shown in claim 1, it is preferable that no nitrogen be added to the above water-soluble lubricant composition and it contain substantially no nitrogen. The content of nitrogen in 100 parts by weight of the above water-soluble lubricant composition is usually 0.15 part by weight or below.

As shown in claim 2, the content of nitrogen in the above water-soluble lubricant composition is preferably 0.5 part by weight or below because a nitrogen content exceeding 0.5 part by weight results in water pollution due to an increased amount of nitrogen compounds in a waste fluid and air pollution due to a large amount of NOx generated during incineration of a waste oil.

As shown in claim 6–9, the content of the above surfactants in 100 parts by weight of the lubricant composition is preferably 1 to 70 parts by weight because a surfactant content less than 1 part by weight can not achieve a stable dispersed state of the composition and that exceeding 70 parts by weight results in reduced lubricity and reduced antifoaming property of the composition.

Besides, as shown in claim 6–9, the content of one or two salts selected from among the above carboxylates and sulfonates in 100 parts by weight of the lubricant composition is also preferably 1 to 70 parts by weight because a salt content less than 1 part by weight can not achieve sufficient rust inhibiting property and lubricity of the composition and that exceeding 70 parts by weight can not achieve a stable dispersed state of the composition.

In addition, as shown in claim 10, 100 parts by weight of the lubricant composition of this invention may contain 20 to 40 parts by weight of surfactants (a), 1 to 10 parts by weight of one or two salts (b) selected from among alkaline earth metal salts and zinc salts of carboxylic acids and sulfonic acid, 60 to 75 parts by weight of mineral oils and substantially no or 0.5 part by weight or below of nitrogen. Lubricant compositions having compositions within this range have superior properties and a good property balance and are of great utility.

Here, spindle oils, machine oils, cylinder oils, turbine oils and the like can be used as "mineral oils".

Furthermore, nitrogen-free substances selected from among conventionally used ones can arbitrarily be used in addition to the above ingredients in the water-soluble lubricant composition of this invention. Those substances include, for example, animal and plant fats and oils such as rape oil, palm oil and beef tallow, oiliness improvers such as fatty acids and esters of fatty acids, sulfur-containing extreme pressure agents, antiseptics, rust inhibitors, antifungal agents, antifoaming agents, antioxidants and anticorrosive agents. The water-soluble lubricant composition of this invention can be used either as it is or after dilution with water and, when it is diluted with water, it is appropriate to dilute it 5 to 50 times.

EXAMPLES

This invention will be tangibly described by way of examples in the following.

A performance test and performance evaluation of liquid samples (example products Nos. 1 to 13) according to preferred embodiments of this invention having compositions shown in Tables 1 and 2 and liquid samples (comparative products Nos. 1 to 12) of comparative examples having compositions shown in Tables 3 and 4 were conducted for each item given below in order to clarify the performance of the water-soluble lubricant composition of this invention.

In Tables 1 to 4, polyoxyethylene lauryl ether was an addition product of 9 moles of ethylene oxide. "Sulfonate S465" (a product of SANKO Chemical Co., Ltd.) was used of sodium petroleum sulfonate, "SURCHEM 404" (a product of WITCO Chemical Co., Ltd.) was used as barium petroleum sulfonate, "BRYTON HY-BASE C500" (a product of WITCO Chemical Co., Ltd.) was used as calcium petroleum sulfonate, "Magnesium Sulfonate 400" (a product of WITCO Chemical Co., Ltd.) was used as magnesium petroleum sulfonate, sodium salt of sulfated castor oil was a product of YUSHIRO Chemical Industry Co., Ltd., "NEOCOAT W498" (a product of Yoshikawa Oil and Fat Co., Ltd.) was used as calcium salt of lanolin fatty acid, "NEOCOAT ES-181" (a product of Yoshikawa Oil and Fat Co., Ltd.) was used as barium salt of lanolin fatty acid and "DISPARLON SOF1200" (a product of Yoshikawa Oil and Fat Co., Ltd.) was used as magnesium salt of lanolin fatty acid. Oleic acid diethanolamine given in Tables 3 and 4 is a mixture consisting of oleic acid and diethanolamine in a molar ratio of 1 to 1. In addition, nitrogen contents given in each table are expressed as parts by weight in 100 parts by weight of the lubricant composition. Nitrogen contents were determined by coulometry using a digital total nitrogen analyzer model TN-02 (manufactured by Mitsubishi Chemical Co., Ltd.).

TABLE 1

| Ingredients | Example Product No. 1 | 2 | 3 | 4 | 5 | 6 |
|---|---|---|---|---|---|---|
| Polyoxyethylene lauryl ether | 5 | 5 | 5 | 5 | 5 | 5 |
| Potassium oleate | 2 | 2 | 2 | 2 | 2 | 2 |
| Sodium petroleum sulfonate | 5 | 5 | 5 | 5 | 5 | 5 |
| Sodium salt of sulfated castor oil | 10 | 10 | 10 | 10 | 10 | 10 |
| Sodium dinonyl naphthalenesulfonate | 5 | 5 | 5 | 5 | 5 | 5 |
| Potassium stearate | | | | | 5 | |
| Magnesium stearate | | | | | | 5 |
| Potassium naphthenate | | | | 5 | | |
| Barium petroleum sulfonate | 5 | | | | | |
| Potassium petroleum sulfonate | | 5 | | | | |
| Magnesium petroleum sulfonate | | | 5 | | | |
| Spindle oil | 68 | 68 | 68 | 68 | 68 | 68 |
| Nitrogen content (parts by weight) | 0.03 | 0.04 | 0.03 | 0.03 | 0.03 | 0.03 |

TABLE 2

| Ingredients | Example Product No. 7 | 8 | 9 | 10 | 11 | 12 | 13 |
|---|---|---|---|---|---|---|---|
| Polyoxyethylene lauryl ether | 5 | 5 | 5 | 5 | 5 | 5 | 5 |
| Potassium oleate | 2 | 2 | 2 | 2 | 2 | 2 | 2 |
| Sodium petroleum sulfonate | 5 | 5 | 5 | 5 | 5 | 5 | 5 |
| Sodium salt of sulfated castor oil | 10 | 10 | 10 | 10 | 10 | 10 | 10 |
| Sodium dinonyl naphthalene-sulfonate | 5 | 5 | 5 | 5 | 5 | 5 | 5 |
| Barium dinonyl naphthenate | 5 | | | | | | |
| Calcium dinonyl naphthenate | | 5 | | | | | |
| Zinc dinonyl naphthenate | | | 5 | | | | |
| Lead dinonyl naphthenate | | | | | | | 5 |
| Calcium salt of lanolin fatty acid | | | | 5 | | | |
| Barium salt of lanolin fatty acid | | | | | 5 | | |
| Magnesium salt of lanolin fatty acid | | | | | | 5 | |
| Spindle oil | 68 | 68 | 68 | 68 | 68 | 68 | 68 |
| Nitrogen content (parts by weight) | 0.04 | 0.04 | 0.04 | 0.15 | 0.13 | 0.14 | |

TABLE 3

| Ingredients | Comparative Product No. 1 | 2 | 3 | 4 | 5 | 6 |
|---|---|---|---|---|---|---|
| Polyoxyethylene lauryl ether | 5 | 5 | 5 | 5 | 5 | 5 |
| Potassium oleate | 2 | 2 | 7 | 2 | 2 | 2 |
| Sodium petroleum sulfonate | 20 | 20 | 20 | 20 | 20 | 20 |
| Potassium naphthenate | | | | | | |
| Potassium dinonyl naphthenate | | | | | 5 | |
| Potassium salt of lanolin fatty acid | | | | 5 | | |
| Aluminum stearate | | | | | | |
| Ferric naphthenate | | | | | | |
| Calcium naphthenate | | | | | | |
| Oleic acid diethanolamine | | | | | | |
| Spindle oil | 68 | 73 | 73 | 68 | 68 | |
| Water | | | | | | 73 |
| Nitrogen content (parts by weight) | 0.04 | 0.05 | 0.04 | 0.17 | 0.05 | 0.04 |

TABLE 4

| Ingredients | Comparative Product No. 7 | 8 | 9 | 10 | 11 | 12 |
|---|---|---|---|---|---|---|
| Polyoxyethylene lauryl ether | 7 | 5 | 5 | 5 | 5 | 5 |
| Potassium oleate | 2 | | 2 | 2 | | |
| Sodium petroleum sulfonate | 20 | 20 | 5 | 5 | 15 | 18.5 |
| Potassium naphthenate | 5 | | | | | |
| Potassium dinonyl naphthenate | | | | | | |
| Potassium salt of lanolin fatty acid | | | | | | |
| Sodium salt of sulfated castor oil | | | 10 | 10 | | |
| Sodium dinonyl naphthalenesulfonate | | | 5 | 5 | | |
| Aluminum stearate | | | 5 | | | |
| Ferric naphthenate | | | | 5 | | |
| Calcium naphthenate | | | | | 5 | 5 |
| Oleic acid diethanolamine | | 7 | | | 7 | 3.5 |
| Spindle oil | 68 | 68 | 68 | 68 | 68 | 68 |
| Nitrogen content (parts by weight) | 0.35 | 0.98 | 0.05 | 0.03 | 0.98 | 0.49 |

(1) Test Items, Test Conditions and Performance Evaluation

The test items and test conditions were as follows.

① Lubricity

In this performance test, the friction factor ($\mu$) of each sample was determined by performing a lubrication test using a stick slip testing machine (burden testing machine).

Conditions of the test are given below.

Load: 4 kgf
Test piece: SPCC plate
Ball: SUJ-2(diameter: 4.76 mm)
Slip speed: 1 mm/s
Slip distance: 1 cm
Number of reciprocations: 10 reciprocations
Sample: 0.1 ml (original liquid as it is or its 20-time aqueous dilution)
Friction factor: friction factor for the 10th reciprocation The test results are shown in Table 5.

For both a sample dilution and the original liquid, all example products excluding example products Nos. 6 and 8 had smaller friction factors and showed superior lubricity as compared to the comparative products. Example products Nos. 6 and 8 also showed lubricity levels equal to or higher than those of the comparative products.

TABLE 5

| Example product No. | Friction factor (μ) | Comparative product No. | Friction factor (μ) |
|---|---|---|---|
| For a Sample Dilution | | | |
| 1 | 0.20 | 1 | 0.26 |
| 2 | 0.20 | 2 | 0.26 |
| 3 | 0.21 | 3 | 0.26 |
| 4 | 0.18 | 4 | 0.23 |
| 5 | 0.20 | 5 | 0.24 |
| 6 | 0.25 | 6 | 0.26 |
| 7 | 0.22 | 7 | 0.26 |
| 8 | 0.24 | 8 | 0.26 |
| 9 | 0.20 | 9 | 0.21 |
| 10 | 0.20 | 10 | 0.25 |
| 11 | 0.21 | 11 | 0.21 |
| 12 | 0.21 | 12 | 0.19 |
| 13 | 0.18 | | |
| For the Original Liquid Sample | | | |
| 1 | 0.21 | 1 | 0.27 |
| 2 | — | 2 | — |
| 3 | — | 3 | — |
| 4 | 0.18 | 4 | 0.23 |
| 5 | — | 5 | — |
| 6 | — | 6 | 0.26 |
| 7 | — | 7 | 0.26 |
| 8 | — | 8 | 0.26 |
| 9 | 0.21 | 9 | 0.21 |
| 10 | — | 10 | — |
| 11 | 0.21 | 11 | 0.21 |
| 12 | — | 12 | 0.20 |
| 13 | 0.18 | | |

Furthermore, it was confirmed in the lubrication test that all example products had only slight stick slip.

② Rust inhibiting property

In this performance test, the rust inhibiting property of each sample was evaluated by a cast iron cutting immersion method. Specifically, after 15 g of cast iron chips (quality: FC25) prepared by dry cutting were collected in a 6 mm ϕ Petri dish, a 10- to 30-time aqueous dilution of each liquid sample was added and the chips were immersed in the dilution for five minutes. Next, after the dilution was discarded and the chips were allowed to stand at room temperature (20 C.) for 24 hours, the state of rust development was observed and evaluated. The results are shown in Table 6.

Marks indicating evaluation results and given in the table have the following meanings.

◎: No rust, ○: Several rust spots developed, Δ: ⅓ of the surface rusted, X: ½ of the surface rusted, XX: The entire surface rusted.

It is seen from Table 6 that all example products had rust inhibiting property levels equal to or higher than those of the comparative products. In particular, example product No. 2 (addition of calcium petroleum sulfonate) and example product No. 3 (addition of magnesium petroleum sulfonate) showed excellent rust inhibiting property.

TABLE 6

| Sample No. | Degree of Dilution (times) ×10 | ×20 | ×30 |
|---|---|---|---|
| Example product No. 1 | ◎ | Δ | XX |
| Example product No. 2 | ◎ | ◎ | X |
| Example product No. 3 | ◎ | ◎ | X |
| Example product No. 4 | ○ | X | XX |
| Example product No. 5 | ○ | X | XX |
| Example product No. 6 | Δ | XX | XX |
| Example product No. 7 | ◎ | Δ | XX |
| Example product No. 8 | ○ | X | XX |
| Example product No. 9 | ○ | X | XX |
| Example product No. 10 | ○ | X | XX |
| Example product No. 11 | Δ | XX | XX |
| Example product No. 12 | ◎ | ○ | XX |
| Example product No. 13 | ○ | X | XX |
| Comparative product No. 1 | ○ | X | XX |
| Comparative product No. 2 | ○ | X | XX |
| Comparative product No. 3 | ◎ | Δ | X |
| Comparative product No. 4 | ◎ | ○ | Δ |
| Comparative product No. 5 | ◎ | Δ | X |
| Comparative product No. 6 | X | XX | XX |
| Comparative product No. 7 | Δ | X | XX |
| Comparative product No. 8 | ◎ | Δ | XX |
| Comparative product No. 9 | X | XX | XX |
| Comparative product No. 10 | X | XX | XX |
| Comparative product No. 11 | ◎ | ◎ | Δ |
| Comparative product No. 12 | ◎ | ◎ | X |

③ Antiseptic property

In this performance test, the antiseptic property of each sample was evaluated by determining viable microbe cell numbers. First, each liquid sample was diluted with water 20 times and 300 ml of the dilution was collected in a 500 ml Erlenmeyer's flask. Next, after the pH of the above dilution was adjusted to 9.0 by adding sulfuric acid, 5% (15 ml) of a putrefied solution containing $1\times10^7$ viable microbe cells per ml was added and the mixture was subjected to shaking culture at 30° C. In addition, 1% (3 ml) of the putrefied solution was added on each of the 7th and the 14th days of the test and successive changes in viable microbe cell number were observed. The results are shown in Tables 7 and 8. Viable microbe cell numbers were determined by a plate counting method.

As noted in Tables 7 and 8, no notable increases of viable microbe cell number were detected in any of the example products and they showed antiseptic property levels equal to or higher than those of the comparative products. In particular, all example products showed remarkably improved antiseptic property as compared to comparative product No. 8 which contained an alkanolamine. Example products Nos. 1 to 5 and 12, especially example products No. 4 (addition of calcium naphthenate) and No. 5 (addition of calcium stearate) had excellent antiseptic property. Comparative product No. 7 which contained 0.35% of nitrogen as impurity also had a small degree of putrefaction which is within the normal range.

TABLE 7

| Sample No. | Days after the Start of the Test 5 | 10 | 15 | 20 | 30 |
|---|---|---|---|---|---|
| Example product No. 1 | $5\times10^5$ | $1\times10^6$ | $1\times10^6$ | $1\times10^5$ | $5\times10^5$ |
| Example product No. 2 | $5\times10^5$ | $1\times10^6$ | $2\times10^6$ | $1\times10^6$ | $7\times10^5$ |
| Example product No. 3 | $5\times10^5$ | $1\times10^6$ | $2\times10^6$ | $1\times10^6$ | $5\times10^5$ |
| Example product No. 4 | $1\times10^5$ | $1\times10^5$ | $3\times10^5$ | $3\times10^5$ | $2\times10^5$ |
| Example product No. 5 | $1\times10^5$ | $1\times10^5$ | $5\times10^5$ | $5\times10^5$ | $5\times10^5$ |
| Example product No. 6 | $5\times10^6$ | $1\times10^7$ | $1\times10^7$ | $1\times10^7$ | $5\times10^6$ |
| Example product No. 7 | $1\times10^6$ | $2\times10^6$ | $2\times10^6$ | $1\times10^6$ | $5\times10^5$ |
| Example product No. 8 | $1\times10^6$ | $1\times10^6$ | $2\times10^6$ | $2\times10^6$ | $1\times10^6$ |
| Example product No. 9 | $1\times10^6$ | $2\times10^6$ | $2\times10^6$ | $3\times10^6$ | $1\times10^6$ |

TABLE 7-continued

| Sample No. | Days after the Start of the Test 5 | 10 | 15 | 20 | 30 |
|---|---|---|---|---|---|
| Example product No. 10 | $1 \times 10^6$ | $2 \times 10^6$ | $2 \times 10^6$ | $3 \times 10^6$ | $1 \times 10^6$ |
| Example product No. 11 | $5 \times 10^6$ | $1 \times 10^7$ | $5 \times 10^6$ | $3 \times 10^6$ | $3 \times 10^6$ |
| Example product No. 12 | $5 \times 10^5$ | $1 \times 10^6$ | $1 \times 10^6$ | $5 \times 10^5$ | $5 \times 10^5$ |
| Example product No. 13 | $1 \times 10^5$ | $1 \times 10^5$ | $3 \times 10^5$ | $3 \times 10^5$ | $2 \times 10^5$ |

TABLE 8

| Sample No. | Day after the start of the test 5 | 10 | 15 | 20 | 30 |
|---|---|---|---|---|---|
| Comparative product No. 1 | $1 \times 10^6$ | $2 \times 10^6$ | $2 \times 10^6$ | $1 \times 10^6$ | $1 \times 10^6$ |
| Comparative product No. 2 | $1 \times 10^6$ | $1 \times 10^6$ | $2 \times 10^6$ | $2 \times 10^6$ | $2 \times 10^6$ |
| Comparative product No. 3 | $1 \times 10^6$ | $2 \times 10^6$ | $3 \times 10^6$ | $2 \times 10^6$ | $2 \times 10^6$ |
| Comparative product No. 4 | $1 \times 10^6$ | $1 \times 10^6$ | $2 \times 10^6$ | $2 \times 10^6$ | $2 \times 10^6$ |
| Comparative product No. 5 | $1 \times 10^6$ | $1 \times 10^6$ | $1 \times 10^6$ | $1 \times 10^6$ | $1 \times 10^6$ |
| Comparative product No. 6 | $2 \times 10^6$ | $2 \times 10^6$ | $3 \times 10^6$ | $3 \times 10^6$ | $3 \times 10^6$ |
| Comparative product No. 7 | $1 \times 10^6$ | $1 \times 10^6$ | $2 \times 10^6$ | $2 \times 10^6$ | $2 \times 10^6$ |
| Comparative product No. 8 | $1 \times 10^7$ | $2 \times 10^7$ | $5 \times 10^8$ | $3 \times 10^8$ | $3 \times 10^8$ |
| Comparative product No. 9 | $5 \times 10^6$ | $1 \times 10^7$ | $5 \times 10^6$ | $3 \times 10^6$ | $3 \times 10^6$ |
| Comparative product No. 10 | $5 \times 10^6$ | $1 \times 10^7$ | $1 \times 10^7$ | $1 \times 10^7$ | $5 \times 10^6$ |
| Comparative product No. 11 | $1 \times 10^6$ | $1 \times 10^6$ | $2 \times 10^6$ | $5 \times 10^6$ | $1 \times 10^7$ |
| Comparative product No. 12 | $1 \times 10^6$ | $1 \times 10^6$ | $2 \times 10^6$ | $2 \times 10^6$ | $5 \times 10^6$ |

④ Corrosion preventing property

In this performance test, first, three types of polished washed test pieces (30×50 mm) were prepared which consisted of aluminum "A1050P" (Japanese Industrial Standard Number), zinc "ZnP-1" (Japanese Industrial Standard Number) and magnesium alloy "H5203MC1" (Japanese Industrial Standard Number). Next, after these test pieces were immersed in each sample dilution (20 times) and allowed to stand at 50° C. for 48 hours, changes in the weights of the test pieces and their surface appearances were examined. The results are shown in Tables 9 and 10.

Marks indicating appearance changes and given in these tables have the following meanings.

○: No changes, Δ: Slight change, X: Marked discoloration.

As noted in Tables 9 and 10, all example products showed remarkably improved corrosion preventing property for all of Al, Zn and Mg.

⑤ Antifoaming property

In this performance test, the antifoaming property of each sample was evaluated by determining the amount of foaming. Specifically, after 500 ml of a 20-time aqueous dilution of each sample was collected in a 1 L beaker, air was supplied into the dilution at a rate of 4 L/minute by means of an air pump and the amount of foaming (cc) was determined. The results are shown in Table 11.

TABLE 9

| Test Piece No. | Aluminum Appearance | Aluminum Weight change (mg) | Zinc Appearance | Zinc Weight change (mg) | Magnesium Appearance | Magnesium Weight change (mg) |
|---|---|---|---|---|---|---|
| Example product No. 1 | ○ | +0.5 | ○ | +2.5 | Δ | −1.9 |
| Example product No. 2 | ○ | +0.5 | ○ | +0.5 | ○ | −1.2 |
| Example product No. 3 | ○ | +0.7 | ○ | +0.3 | ○ | −1.0 |
| Example product No. 4 | ○ | +0.8 | ○ | +3.5 | Δ | −2.1 |
| Example product No. 5 | ○ | +1.0 | ○ | +2.0 | Δ | −2.5 |
| Example product No. 6 | ○ | +0.5 | ○ | −2.0 | Δ | −0.8 |
| Example product No. 7 | ○ | +1.0 | ○ | +0.5 | ○ | −2.6 |
| Example product No. 8 | ○ | +1.0 | ○ | +3.1 | Δ | −0.7 |
| Example product No. 9 | ○ | +1.5 | ○ | +0.3 | ○ | −0.5 |
| Example product No. 10 | ○ | +1.2 | ○ | +0.2 | ○ | −3.1 |
| Example product No. 11 | ○ | +0.2 | ○ | +2.1 | Δ | −1.9 |
| Example product No. 12 | ○ | +1.0 | ○ | +2.6 | Δ | −1.9 |
| Example product No. 13 | ○ | +0.8 | ○ | +3.5 | Δ | −2.1 |

TABLE 10

| Sample No. | Aluminum Appearance | Aluminum Weight change (mg) | Zinc Appearance | Zinc Weight change (mg) | Magnesium Appearance | Magnesium Weight change (mg) |
|---|---|---|---|---|---|---|
| Comparative product No. 1 | X | −0.7 | Δ | −4.5 | Δ | −2.1 |
| Comparative product No. 2 | X | −0.3 | Δ | −3.6 | Δ | −2.7 |
| Comparative product No. 3 | X | −1.5 | X | −5.3 | Δ | −3.1 |
| Comparative product No. 4 | X | −1.0 | Δ | −2.5 | Δ | −3.0 |
| Comparative product No. 5 | X | −2.1 | X | −6.0 | Δ | −4.1 |
| Comparative product No. 6 | X | −2.6 | X | −6.7 | Δ | −4.5 |
| Comparative product No. 7 | X | −1.8 | X | −5.5 | Δ | −2.9 |
| Comparative product No. 8 | X | −1.3 | Δ | −4.9 | Δ | −8.5 |
| Comparative product No. 9 | ○ | +0.2 | ○ | +2.1 | Δ | −1.9 |
| Comparative product No. 10 | ○ | +0.5 | ○ | −2.0 | Δ | −0.8 |

TABLE 10-continued

| Sample No. | Aluminum | | Zinc | | Magnesium | |
|---|---|---|---|---|---|---|
| | Appearance | Weight change (mg) | Appearance | Weight change (mg) | Appearance | Weight change (mg) |
| Comparative product No. 11 | Δ | −1.0 | Δ | −1.5 | Δ | −3.0 |
| Comparative product No. 12 | Δ | −0.5 | Δ | −1.0 | Δ | −2.4 |

As noted in Table 11, all examples products had remarkably reduced amounts of foaming and showed excellent antifoaming property as compared to the comparative products.

(2) Overall Evaluation

The example products have superior lubricity, rust inhibiting property, antiseptic property and antifoaming property as well as superior corrosion preventing property for non-ferrous metals, have a very good property balance and are of great utility. Particularly, the corrosion preventing property and antifoaming property of these products are remarkably superior to those of conventional products.

This invention is not restricted to those products given in the above examples and various different water-soluble lubricant compositions according to preferred embodiments of this invention can be produced within its range according to purpose and use.

TABLE 11

| Sample No. | Amount of foaming (cc) | |
|---|---|---|
| | 1 hour after | 24 hours after |
| Example product No. 1 | 20 | 5 |
| Example product No. 2 | 10 | 5 |
| Example product No. 3 | 10 | 5 |
| Example product No. 4 | 10 | 5 |
| Example product No. 5 | 10 | 5 |
| Example product No. 6 | 20 | 5 |
| Example product No. 7 | 10 | 5 |
| Example product No. 8 | 20 | 5 |
| Example product No. 9 | 10 | 5 |
| Example product No. 10 | 10 | 5 |
| Example product No. 11 | 20 | 5 |
| Example product No. 12 | 20 | 5 |
| Example product No. 13 | 10 | 5 |
| Comparative product No. 1 | 30 | 50 |
| Comparative product No. 2 | 30 | 50 |
| Comparative product No. 3 | 50 | 60 |
| Comparative product No. 4 | 30 | 40 |
| Comparative product No. 5 | 50 | 50 |
| Comparative product No. 6 | 50 | 50 |
| Comparative product No. 7 | 40 | 40 |
| Comparative product No. 8 | 80 | 70 |
| Comparative product No. 9 | 20 | 5 |
| Comparative product No. 10 | 20 | 5 |
| Comparative product No. 11 | 40 | 5 |
| Comparative product No. 12 | 40 | 5 |

What is claimed is:

1. A water-soluble lubricant composition containing surfactants (a) and at least one salt (b) selected from salts of fatty acids containing at least 8 carbon atoms, salts of naphthenic acid and salts of petroleum sulfonic acid, in which said at least one salt (b) is an alkaline earth metal salt, zinc salt or lead (divalent) salt, substantially no nitrogen ingredients are contained and the amount of nitrogen contained represents its amount in impurities.

2. A water-soluble lubricant composition containing surfactants (a) and at least one salt (b), in which said at least one salt (b) is an alkaline earth metal salt or zinc salt of fatty acids containing at least 8 carbon atoms, salts of naphthenic acid and petroleum sulfonic acid and 100 parts by weight of which contains 0.5 parts by weight or below of nitrogen.

3. A water-soluble lubricant composition as defined in claim 1 or 2, wherein said surfactants (a) consist of one or at least two compounds selected from the group consisting of etheric nonionic surfactants, esteric nonionic surfactants, sulfated oils, alkali metal salts of carboxylic acids and alkali metal salts of sulfonic acid.

4. A water-soluble lubricant composition as defined in one of claims 1 or 2, 100 parts by weight of which contains 1 to 70 parts by weight of said surfactants (a) and 1 to 70 parts by weight of said one or two salts (b).

5. A water-soluble lubricant composition as defined in claim 3, 100 parts by weight of which contains 1 to 70 parts by weight of said surfactants (a) and 1 to 70 parts by weight of said one or two salts (b).

6. A water-soluble lubricant composition, 100 parts by weight of which contains 20 to 40 parts by weight of surfactants (a), 1 to 10 parts by weight of at least one salt (b) selected from alkaline earth metal salts and zinc salts of fatty acids containing at least 8 carbon atoms, salts of naphthenic acid and petroleum sulfonic acid, 60 to 75 parts by weight of mineral oils and substantially no or 0.5 parts by weight or below of nitrogen.

7. A water-soluble lubricant composition as defined in claim 6, wherein said surfactants are one or at least two compounds selected from the group consisting of polyoxyethylene alkyl ethers, alkali salts of oleic acid, alkali salts of petroleum sulfonic acid, sodium salt of sulfated castor oil and sodium alkyl naphthalenesulfonates.

8. A water-soluble lubricant composition as defined in claim 6, wherein said carboxylates consist of one or at least two compounds selected from the group consisting of calcium stearate, magnesium stearate and calcium naphthenates and said sulfonates consist of one or at least two compounds selected from the group consisting of barium petroleum sulfonate, calcium petroleum sulfonate and magnesium petroleum sulfonate.

* * * * *

UNITED STATES PATENT AND TRADEMARK OFFICE

CERTIFICATE OF CORRECTION

PATENT NO. : 5,322,631

DATED : June 21, 1994

INVENTOR(S) : Masaharu Fuchigami et al.

It is certified that error appears in the above-indentified patent and that said Letters Patent is hereby corrected as shown below:

Claim 1, Column 11, Line 56 "8" should be --12--.

Claim 2, Column 12, Line 16 "8" should be --12--.

Claim 6, Column 12, Line 38 "8" should be --12--.

Signed and Sealed this

Thirty-first Day of January, 1995

*Attest:*

*Attesting Officer*

BRUCE LEHMAN

*Commissioner of Patents and Trademarks*